US009936320B2

(12) United States Patent
Mizumoto et al.

(10) Patent No.: US 9,936,320 B2
(45) Date of Patent: Apr. 3, 2018

(54) TEST DEVICE AND TEST METHOD FOR MICROPHONE ARRAYS

(71) Applicant: HONDA MOTOR CO., LTD., Tokyo (JP)

(72) Inventors: Takeshi Mizumoto, Wako (JP); Keisuke Nakamura, Wako (JP); Kazuhiro Nakadai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/446,178

(22) Filed: Mar. 1, 2017

(65) Prior Publication Data

US 2017/0289716 A1 Oct. 5, 2017

(30) Foreign Application Priority Data

Mar. 29, 2016 (JP) ..... 2016-065005

(51) Int. Cl.
*H04R 29/00* (2006.01)

(52) U.S. Cl.
CPC ..... *H04R 29/006* (2013.01)

(58) Field of Classification Search
CPC .... H04R 29/00; H04R 29/004; H04R 29/005; H04R 29/006
USPC ..... 381/58
See application file for complete search history.

(56) References Cited

U.S. PATENT DOCUMENTS

2006/0262942 A1* 11/2006 Oxford ..... H04M 1/6008 381/66
2013/0058492 A1* 3/2013 Silzle ..... H04R 5/027 381/59
2016/0071508 A1* 3/2016 Wurm ..... G10K 11/1784 381/58

FOREIGN PATENT DOCUMENTS

JP 2015-154207 8/2015

* cited by examiner

*Primary Examiner* — Matthew Eason
*Assistant Examiner* — Sabrina Diaz
(74) *Attorney, Agent, or Firm* — Rankin, Hill & Clark LLP

(57) ABSTRACT

A transfer function calculation unit is configured to calculate a transfer function from a sound source installed in a predetermined target direction to each microphone of a microphone array, and a determination unit is configured to determine whether or not the microphone array is normal on the basis of a difference amount between a transfer function to each microphone and a predetermined ideal transfer function to each microphone.

6 Claims, 5 Drawing Sheets

TEST DEVICE AND TEST METHOD FOR MICROPHONE ARRAYS

CROSS-REFERENCE TO RELATED APPLICATION

Priority is claimed on Japanese Patent Application No. 2016-065005, filed Mar. 29, 2016, the content of which is incorporated herein by reference.

BACKGROUND OF THE INVENTION

Field of the Invention

The present invention relates to a test device and a test method.

Description of Related Art

A microphone array including a plurality of microphones is used for recording of multi-channel acoustic signals. A multi-channel acoustic signal recorded by such a microphone array is used for sound source separation for separation into sound on a speaker basis according to speaking of a plurality of speakers or sound source localization for determining a direction of a sound source. In a sound source separation or sound source localization process, information on a difference in transfer characteristics from a sound source according to a difference in position between microphones is used.

For example, Japanese Unexamined Patent Publication, First Publication No. 2015-154207 discloses an acoustic processing device that calculates a sound reception position of an acoustic signal and a sound source direction on the basis of acoustic signals of a plurality of channels.

SUMMARY OF THE INVENTION

When a microphone array is mass-produced, testing of the produced microphone array is performed. The testing of the microphone array includes testing of an arrangement of a plurality of microphones constituting a microphone array, in addition to an arrangement of a casing and each microphone. This is because a relative positional relationship between the casing and the plurality of microphones arranged in the casing may be important depending on applications. Therefore, testing of an operation or a position of each microphone is an unreliable test.

An aspect of the present invention has been made in view of the above points, and an object thereof is to provide a test device and a test method capable of testing a relative positional relationship between a plurality of microphones constituting a microphone array.

In order to achieve the above object, the present invention adopts the following aspects.

(1) A test device according to an aspect of the present invention includes: a transfer function calculation unit configured to calculate a transfer function from a sound source installed in a predetermined target direction to each microphone of a microphone array; and a determination unit configured to determine whether or not the microphone array is normal on the basis of a difference amount between a transfer function to each microphone and a predetermined ideal transfer function to each microphone.

(2) In the above aspect (1), the test device may further include a representative transfer function determination unit configured to cluster, between the target directions, a time difference between the microphones of sound from the sound source and determine the transfer function corresponding to a representative value of the time difference for each cluster obtained by the clustering as a representative transfer function, and the determination unit may be configured to determine whether the microphone array is normal on the basis of an inter-cluster representative value of the difference amount between the representative transfer function and the ideal transfer function for each cluster, as the difference amount.

(3) In the aspect (2), the determination unit may be configured to calculate a Euclidean distance between the representative transfer function and the ideal transfer function, as the difference amount.

(4) In the aspect (2), the determination unit may be configured to calculate a weighted Euclidean distance by multiplying a difference between the representative transfer function and the ideal transfer function by a predetermined auditory weighting characteristic, as the difference amount.

(5) In the aspect (2), the determination unit may be configured to calculate an inter-frequency integral value of a weighted sum obtained by weighting each of a phase difference and an intensity difference between the representative transfer function and the ideal transfer function with a predetermined weighting characteristic, as the difference amount.

(6) In the aspect (2), the test device may further include a calibration value calculation unit configured to calculate a calibration value for reducing the difference amount between a transfer function from the sound source and the ideal transfer function.

(7) A test method according to an aspect of the present invention includes: a transfer function calculation step of calculating a transfer function from a sound source installed in a predetermined target direction to each microphone of a microphone array; and a determination step of determining whether or not the microphone array is normal on the basis of a difference amount between a transfer function to each microphone and a predetermined ideal transfer function to each microphone.

According to the above-described aspects (1) and (7), it is determined whether or not the microphone array is normal on the basis of the difference amount between the transfer function from the sound source installed in the target direction to each microphone and the ideal transfer function to each microphone. Therefore, it is possible to quantitatively determine whether a relative positional relationship between the microphones constituting the microphone array is good or poor.

In the case of the above-described (2), a cluster consisting of the time difference between the microphones for each target direction is formed, and the representative value of the time difference for each formed cluster is determined as the representative transfer function. Since the transfer function corresponding to the target direction is determined as the representative transfer function, it is possible to avoid the influence of noise or other sound sources or the influence of a setting error for the target direction in the selection of the representative transfer function. Further, the inter-cluster representative value of the difference amount between the representative transfer function and the ideal transfer function for each cluster is a value representative of a degree of influence of noise or other sound sources that may vary between target directions or the influence of the setting error for the target direction. On the basis of this value, it is quantitatively determined whether or not the microphone array is normal.

In the case of the above-described (3), contributions of the difference between the representative transfer function and the ideal transfer function are accumulated between the frequencies and the microphones, and thus the difference amount is calculated. Therefore, it is quantitatively determined whether or not the microphone array is normal on the basis of physical characteristics of the transfer function according to the arrangement of the microphones.

In the case of the above-described (4), contributions of the difference weighted with the auditory weighting characteristic indicating the auditory characteristics for human noise are accumulated between frequencies and thus the difference amount is calculated. Therefore, it is quantitatively determined whether or not the microphone array is normal on the basis of the auditory characteristics of the differences between the received sound signals generated according to the arrangement of the microphones.

In the case of the above-described (5), as a difference in physical characteristics between the representative transfer function and the ideal transfer function, contributions of the weighted sum obtained by weighting the phase difference and the intensity difference with each of predetermined weight characteristics are accumulated between frequencies to calculate the difference amount. Therefore, it is quantitatively determined whether or not the microphone array is normal on the basis of predetermined weight characteristics that are set for each of the phase difference and the intensity difference generated according to the arrangement of the microphones.

In the case of the above-described (6), a received sound signal approximate to the received sound signal from the microphone array giving the ideal transfer function can be acquired by calibrating the received sound signal from the microphones using the calculated calibration value. Further, troublesome work related to adjustment of various parameters of the received signal between the channels, which is performed by the user, is reduced.

DETAILED DESCRIPTION OF THE INVENTION

Hereinafter, embodiments of the present invention will be described with reference to the drawings.

Figure 1:
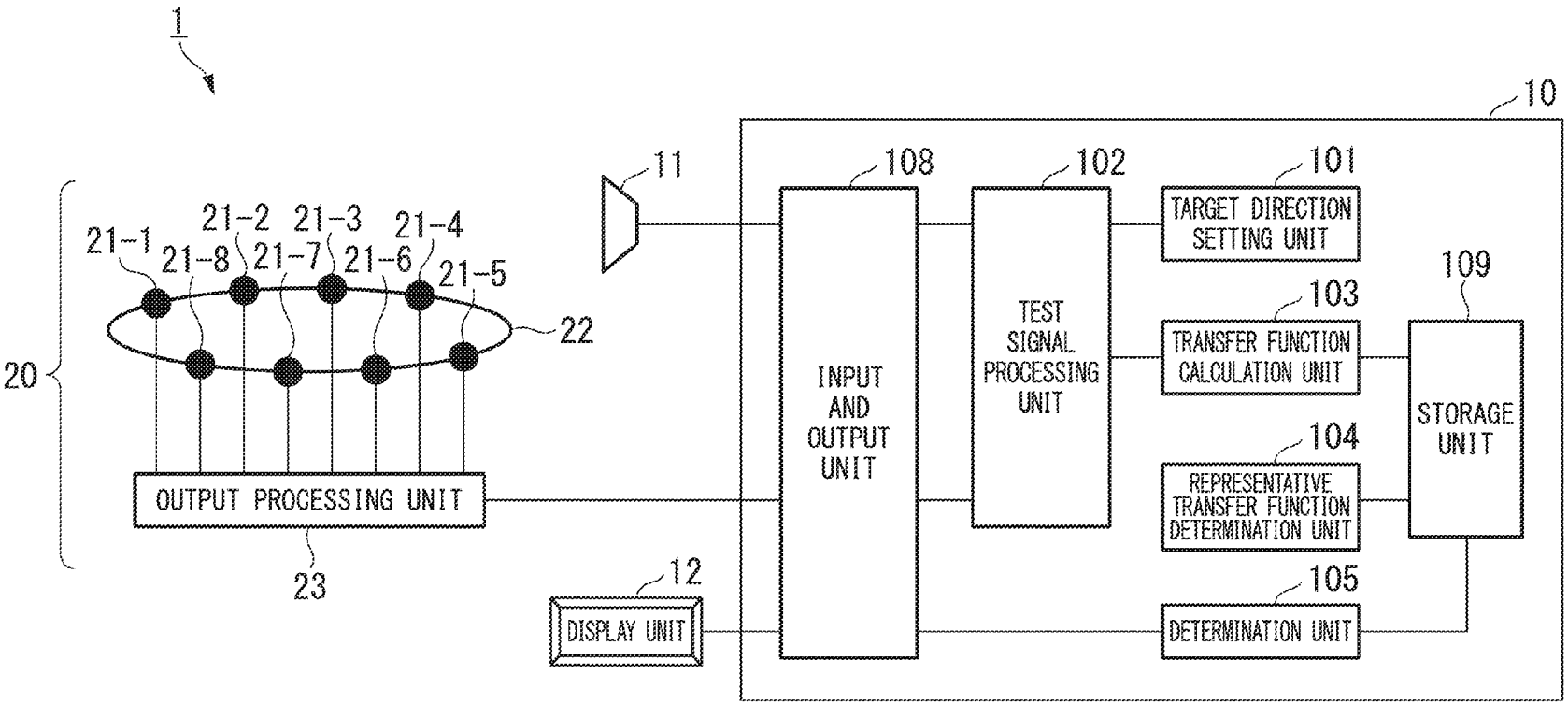
FIG. 1 is a block diagram illustrating a configuration of a test system according to the embodiment.

FIG. 1 is a block diagram illustrating a configuration of a test system 1 according to the embodiment.

The test system 1 according to the embodiment includes a test device 10.

The test device 10 tests whether or not an arrangement of M (M is an integer equal to or greater than 2) microphones 21-1 to 21-M included in a microphone array 20 satisfies a predetermined specification.

In the example illustrated in FIG. 1, M is 8. The test device 10 includes a speaker 11 as a sound source that presents sound on the basis of a predetermined sound signal as a test signal. The test device 10 calculates a transfer function from the speaker 11 to each of the microphones 21-1 to 21-M on the basis of received sound signals from the microphones 21-1 to 21-M.

The test device 10 determines whether or not an arrangement of the microphones 21-1 to 21-M in the microphone array 20 is normal on the basis of a difference amount between the calculated transfer function from the speaker 11 to each of the microphones 21-1 to 21-M and a predetermined ideal transfer function from the speaker 11 to each of the microphones 21-1 to 21-M.

The microphone array 20 includes M microphones 21-1 to 21-M, a support unit 22, and an output processing unit 23.

The microphones 21-1 to 21-M are electro-acoustic conversion elements that convert incoming sound into a received sound signal that is an electric signal. The microphones 21-1 to 21-M output the converted received sound signals to the output processing unit 23. The microphones 21-1 to 21-M are arranged at different positions in the support unit 22. However, the arrangements of the microphones 21-1 to 21-8 are also different between the same models of microphone arrays 20. Therefore, the transfer functions are different between the microphones 21-1 to 21-M.

The support unit 22 is a member that supports the microphones 21-1 to 21-M. In the example illustrated in FIG. 1, a shape of the support unit 22 is an annular shape, and the microphones 21-1 to 21-M are arranged at substantially equal intervals.

The output processing unit 23 performs a predetermined process on the received sound signals respectively input from the microphones 21-1 to 21-M. The predetermined process includes, for example, analog-to-digital (A/D) conversion or amplification (or attenuation).

The output processing unit 23 is connected to the test device 10 in a wired or wireless manner, and outputs received sound signals of M channels from the microphones 21-1 to 21-M obtained by performing the predetermined process on the test device 10.

(Test Device)

Next, a configuration of the test device 10 according to the embodiment will be described. The test device 10 includes a target direction setting unit 101, a test signal processing unit 102, a transfer function calculation unit 103, a representative transfer function determination unit 104, a determination unit 105, an input and output unit 108, a storage unit 109, a speaker 11, and a display unit 12.

The target direction setting unit 101 sets a target direction of the speaker 11 that presents sound based on the test signal from the microphone array 20. The target direction is a relative direction of the speaker 11 with respect to a representative point on the microphone array 20. The representative point on the microphone array 20 is, for example, a center of gravity point of the M microphones 21-1 to 21-M. In one test, a transfer function is acquired for each of preset D target directions (D is an integer equal to or greater than 2). For example, the target direction is set at predetermined intervals in a horizontal plane. The setting interval is, for example, an arbitrary angle from 1 to 90°. The target direction setting unit 101 selects any one of the D target directions. The target direction setting unit 101 outputs target direction information indicating the selected target direction to the test signal processing unit 102 when the selection of the target direction is completed.

The target direction setting unit 101 may include any one or a combination of a driving unit (not illustrated) that changes a position or a direction of the microphone array 20, a driving unit (not illustrated) that changes a position or a direction of the speaker 11 or the test device 10 itself, and a selection unit (not illustrated) that selects the speaker 11 that presents sound among a plurality of speakers 11 at different positions. The driving unit or the selection unit may be provided on a test line of the microphone array 20. An example of setting the target direction will be described below.

The test signal processing unit 102 generates a predetermined test signal when the target direction information is input from the target direction setting unit 101. The test signal is used for presentation of sound that is used for measurement of a transfer function. The test signal includes components in a frequency band to be received by the respective microphones 21-1 to 21-M. This frequency band is a band that may be appropriately used according to test purposes, such as a band of the sound of speaking by a human (typically 100 Hz to 4 kHz), and an audible band (20 Hz to 20 kHz) in which a human can perceive sound. For example, white noise, pink noise, a chirp signal, an M-sequence signal, or the like can be used as the test signal. The test signal processing unit 102 outputs the test signal to the speaker 11 installed in the target direction indicated by the target direction information via the input and output unit 108.

The received sound signal of M channels is input from the microphone array 20 to the test signal processing unit 102 via the input and output unit 108. The test signal processing unit 102 associates the test signal and the received sound signal of M channels with the target direction information, and outputs the resultant signal to the transfer function calculation unit 103. In the following description, the channels of the received sound signals from the microphones 21-1 to 21-M may be referred to as channels 1 to M, respectively.

The test signal processing unit 102 may repeat a process of outputting a test signal for each target direction and a process of inputting and outputting the received sound signal a plurality of times. A plurality of sets of transfer functions of M channels are calculated for each target direction using the received sound signals of M channels acquired through such a repetition.

The target direction information, the test signals, and the received sound signals of M channels are input from the test signal processing unit 102 to the transfer function calculation unit 103. On the basis of the received sound signal and the test signal of each channel, the transfer function calculation unit 103 calculates the transfer function $H_{[n]m}(\theta, f)$ of a channel.

[Equation 1]

$$H_{[n]m}(\theta, f) = \frac{X_{[n]m}(\theta, f)}{S(f)} \tag{1}$$

In Equation (1), n and m indicate the number of measurements and the channel, respectively. θ and f indicate the target direction and the frequency, respectively. S(f) indicates a component at a frequency f of the test signal. $X_{[n]m}(\theta, f)$ indicates the component at the frequency f of the received sound signal related to channel m from an nth target direction θ.

The transfer function calculation unit 103 stores the target direction information and the calculated transfer function of M channels in the storage unit 109 in association with each other. The transfer function calculation unit 103 further stores the received sound signal of M channels used for calculation of the transfer functions in the storage unit 109 in association with each other.

The representative transfer function determination unit 104 calculates an inter-channel time difference using the received sound signal used for the calculation of the transfer function of M channels of each time stored in the storage unit 109. The inter-channel time difference is a sound arrival time difference between a microphone related to a predetermined reference channel and a microphone related to another channel. Therefore, the inter-channel time difference is calculated for each of the M−1 other channels other than the reference channel. In the following description, the reference channel is, for example, channel 1.

The representative transfer function determination unit 104 forms the inter-channel time difference vector $\tau_{[n]}(\theta)$ having M−1 inter-channel time differences $\tau_{[n]2}(\theta), \ldots, \tau_{[n]M}(\theta)$ according to target directions of each time as components thereof, as illustrated in Equation (2). In Equation (2), T denotes a transpose of a vector or a matrix.

[Equation 2]

$$\tau_{[n]}(\theta)=[\tau_{[n]2}(\theta),\tau_{[n]3}(\theta), \ldots ,\tau_{[n]M}(\theta)]^T \tag{2}$$

The representative transfer function determination unit 104 performs clustering on an inter-channel time difference vector obtained on the basis of the transfer function of each time to perform classification into D clusters. When performing clustering, the representative transfer function determination unit 104 uses, for example, a group averaging method which is one hierarchical clustering scheme.

The representative transfer function determination unit 104 calculates an average value of the inter-channel time difference vectors $\tau_{[n]}$ belonging to each cluster d among the D clusters as a cluster center $\tau_d$. The representative transfer function determination unit 104 calculates a distance $\delta_{[n]d}$ between the inter-channel time difference vector $\tau_{[n]}$ belonging to each cluster d and the cluster center $\tau_d$ using, for example, Equation (3).

[Equation 3]

$$\delta_{[n]d}=\|\tau_{[n]}-\tau_d\| \tag{3}$$

The representative transfer function determination unit 104 specifies the inter-channel time difference vector $\tau_{[n]}$ for applying a smallest distance $\delta_{[n]d}$ to each cluster d as the representative inter-channel time difference vector of the cluster d. The representative transfer function determination unit 104 determines the transfer function $H_{[n]m}(\theta, f)$ corresponding to the specified representative inter-channel time difference vector $\tau_{[n]}$ as the representative transfer function $H_m(d, f)$ as illustrated in Equation (4).

[Equation 4]

$$H_m(d, f) = \underset{H_{[n]m}(\theta,f)}{\arg\min}\,\delta_{[n]d} \tag{4}$$

The representative transfer function determination unit 104 stores representative transfer function information indicating the representative transfer function for each cluster in the storage unit 109. The cluster center $\tau_d$ indicates a representative value of the inter-channel difference for an arrival time of the sound from the sound source installed in the target direction θ corresponding to the cluster d to the respective microphones 21-1 to 21-M.

The determination unit 105 reads the representative transfer function information and previously stored reference representative transfer function information from the storage unit 109. The reference representative transfer function information is information indicating a transfer function to each microphone of a non-defective product serving as a determination criterion as an ideal transfer function that is a reference. Hereinafter, this transfer function is referred to as a reference representative transfer function. For example, a transfer function according to a design specification, a transfer function of an existing microphone array 20 determined to satisfy a predetermined test item, or the like may be used as the reference representative transfer function. The reference representative transfer function information includes information on the reference representative transfer function in each target direction to each of the microphones 21-1 to 21-M.

The determination unit 105 performs calculation using a difference amount C between the representative transfer function $H_m(d, f)$ selected for the cluster corresponding to each target direction and the reference representative transfer function $H_m'(d, f)$.

The determination unit 105 may calculate, as an index value indicating the difference amount C, any one of an Euclidean distance shown in Equation (5), a characteristic-A weighted Euclidean distance shown in Equation (6), and a weighted sum of a phase difference and an intensity difference shown in Equation (7).

[Equation 5]

$$C = \sum_m \sum_f |H_m(d, f) - H_m'(d, f)| \tag{5}$$

Equation (5) shows that the difference amount C is calculated by accumulating absolute values of the difference between the representative transfer function $H_m(d, f)$ and the reference representative transfer function $H_m'(d, f)$ over a frequency f and a channel m. Therefore, difference contributions are equally included in the difference amount C regardless of the frequency and the channel.

[Equation 6]

$$C = \sum_m \sum_f A(f) |H_m(d, f) - H_m'(d, f)| \tag{6}$$

In Equation (6), A(f) indicates an intensity of characteristic A for each frequency f. Characteristic A is a weighting coefficient based on frequency characteristics of the sensitivity of a typical auditory sense of a human. Characteristic A is higher than other frequency bands in a frequency band of 1 kHz to 4 kHz, and becomes substantially 0 at 20 Hz or less or 20 kHz or more. That is, Equation (6) shows the difference amount C is calculated by summing multiplication values obtained by multiplying the absolute value of the difference between the representative transfer function $H_m(d, f)$ and the reference representative transfer function $H_m'(d, f)$ by characteristic A dependent on the frequency f over the frequency f and the channel m. Therefore, the difference amount C includes contributions of the difference according to the frequency characteristics of the auditory sense.

[Equation 7]

$$C = \sum_m \sum_f \left( I(f) \log \left| \frac{H_m(d, f)}{H_m'(d, f)} \right| + P(f) \, | \arg(H_m(d, f)) - \arg(H_m'(d, f)) | \right) \tag{7}$$

In Equation (7), I(f) and P(f) indicate weight coefficients dependent on the frequency f by which the intensity difference and the phase difference are multiplied, respectively. arg( . . . ) indicates a phase of the complex number . . . Therefore, Equation (7) shows that the difference amount C is calculated by accumulating a sum of multiplication values obtained by multiplying the intensity difference and the phase difference between the representative transfer function $H_m(d, f)$ and the reference representative transfer function $H_m'$ (d, f) by the weighting coefficients I(f) and P(f), respectively, over the frequency f and the channel m. Therefore, the difference amount C includes contributions corresponding to the frequency characteristics of each of the intensity difference and the phase difference.

The determination unit 105 selects an inter-cluster minimum value $C_{min}$ which is a smallest difference amount among the difference amounts C for each cluster. The determination unit 105 compares the inter-cluster minimum value $C_{min}$ with a predetermined tolerance. When the inter-cluster minimum value $C_{min}$ is smaller than the tolerance, the determination unit 105 determines that the microphone array 20 is a non-defective product. When the inter-cluster minimum value $C_{min}$ is equal to or greater than the tolerance, the determination unit 105 determines that the microphone array 20 is a defective product. The determination unit 105 outputs determination information indicating whether or not the microphone array 20 is a non-defective product to the display unit 12 via the input and output unit 108. The tolerance is a value indicating a magnitude of an allowable difference amount C.

Accordingly, it is determined whether or not the microphone array 20 is a non-defective product on the basis of the inter-cluster minimum value Calm which is the smallest difference amount among the difference amounts C which can vary according to the sound source direction corresponding to the cluster. Therefore, the inter-cluster minimum value $C_{min}$ based on the representative transfer function from the most reliable sound source direction among the measured representative transfer functions is compared with the tolerance. Accordingly, it is possible to eliminate an influence of a sound source other than the speaker 11 installed in the target direction in a test environment.

The determination unit 105 may determine 0.5 to 2.0 times a standard deviation σ of the difference amount C between the plurality of microphone arrays 20 as the tolerance.

The determination unit 105 may select the greatest inter-cluster maximum value $C_{max}$ among the difference amounts C for each cluster instead of the inter-cluster minimum value $C_{min}$, as the representative value of the difference amount C between the clusters. When the inter-cluster maximum value $C_{max}$ is smaller than the tolerance, the determination unit 105 determines that the microphone array 20 is a non-defective product, and when the inter-cluster maximum value $C_{max}$ is greater than the tolerance, the determination unit 105 determines that the microphone array 20 is a defective product. In this case, it is determined whether or not the microphone array 20 is a non-defective product on the basis of the inter-cluster maximum value $C_{max}$ which is the maximum difference amount C among the difference amounts C that can vary according to the sound source direction corresponding to the cluster. Therefore, it is determined whether the microphone array 20 is a non-defective product more strictly than in a case where the inter-cluster minimum value $C_{min}$ is compared with the tolerance.

The input and output unit 108 is connected to the speaker 11, the display unit 12, and the microphone array 20 in a wired or wireless manner to input and output various signals. The input and output unit 108 is, for example, a data input and output interface.

The storage unit 109 stores data used for various processes in the test device 10 and data generated through various processes. The storage unit 109 includes, for example, a storage medium such as a read-only memory (ROM) or a random access memory (RAM).

The display unit 12 displays the determination information input from the determination unit 105. The display unit 12 is, for example, a liquid crystal display (LCD).

(Clustering)

Next, clustering performed by the representative transfer function determination unit 104 will be described.

First, the representative transfer function determination unit 104 calculates the inter-channel time difference as an element of the inter-channel time difference vector that is a clustering target. At the time of calculating the inter-channel time difference, the representative transfer function determination unit 104 uses the received sound signal used for calculation of the transfer function of M channels of each time stored in the storage unit 109. The representative transfer function determination unit 104 calculates a time difference in which a cross-correlation function between channels is maximized as a channel time difference using a multi-channel Generalized Cross-Correlation methods with Phase Transform (GCC-PHAT) method as shown in Equation (8).

[Equation 8]

$$\tau_{[n]m}(\theta) = \arg\max_{\tau} \; E\left(\int_{-\infty}^{+\infty} \frac{X_{[n]1}(\theta, f) X^{*}_{[n]m}(\theta, f)}{|X_{[n]1}(\theta, f) X^{*}_{[n]m}(\theta, f)|} e^{2\pi j f \tau} df\right) \tag{8}$$

$\tau_{[n]m}(\theta)$ indicates the inter-channel time difference between channel m and channel 1 from the n-th target direction θ. $\arg\max_{\tau}$ . . . indicates τ for maximizing . . . E( . . . ) indicates a time average. * indicates a complex conjugate. In the example shown in Equation (8), the inter-channel time difference $\tau_{[n]m}(\theta)$ is calculated for each of M−1 channels other than channel 1 that is a reference each time. Acquisition of a received sound signal of M channels is not limited to one for each target direction θ as described and may be performed a plurality of times.

The representative transfer function determination unit 104 forms the inter-channel time difference vector $\tau_{[n]}(\theta)$ from the inter-channel time difference $\tau_{[n]m}(\theta)$ of M−1 channels calculated each time. The representative transfer function determination unit 104 uses, for example, hierarchical clustering as a clustering scheme that is performed when classifying the formed inter-channel time difference vector $\tau_{[n]}(\theta)$ into D clusters.

Hierarchical clustering is a scheme including the following steps (1) to (4): (1) setting a cluster having one inter-channel time difference vector as a member, (2) integrating clusters having a highest degree of similarity among degrees of similarity between respective clusters to form one cluster, (3) ending a process when the number of clusters reaches D and otherwise proceeding to (4), and (4) calculating the degree of similarity between the cluster formed in (3) and each of other clusters and returning to (3).

The group averaging method is a scheme of calculating a degree of similarity between the inter-channel time difference vectors selected from two respective clusters for each of all sets of inter-channel time difference vectors in the hierarchical clustering, and determining an average value of the calculated degrees of similarity as a degree of similarity between the two clusters.

Specifically, the representative transfer function determination unit 104 calculates the similarity $\Delta_{de}$ between the clusters d and e using, for example, Equation (9).

[Equation 9]

$$\Delta_{de} = \left\| \frac{1}{N_d} \Sigma_{n \in d} \tau_{[n]}(\theta) - \frac{1}{N_e} \Sigma_{n \in e} \tau_{[n]}(\theta) \right\| \tag{9}$$

In Equation (9), $N_d$ and $N_e$ indicate the number of inter-channel time difference vectors $\tau_{[n]}(\theta)$ belonging to the clusters d and e, respectively. Further, | . . . | indicates a norm. That is, Equation (9) shows that a distance from the average value of the inter-channel time difference vector $\tau_{[n]}(\theta)$ belonging to the cluster d to the average value of the inter-channel time difference vector $\tau_{[n]}(\theta)$ belonging to the cluster e is calculated as a similarity degree $\Delta_{de}$.

Figure 2:
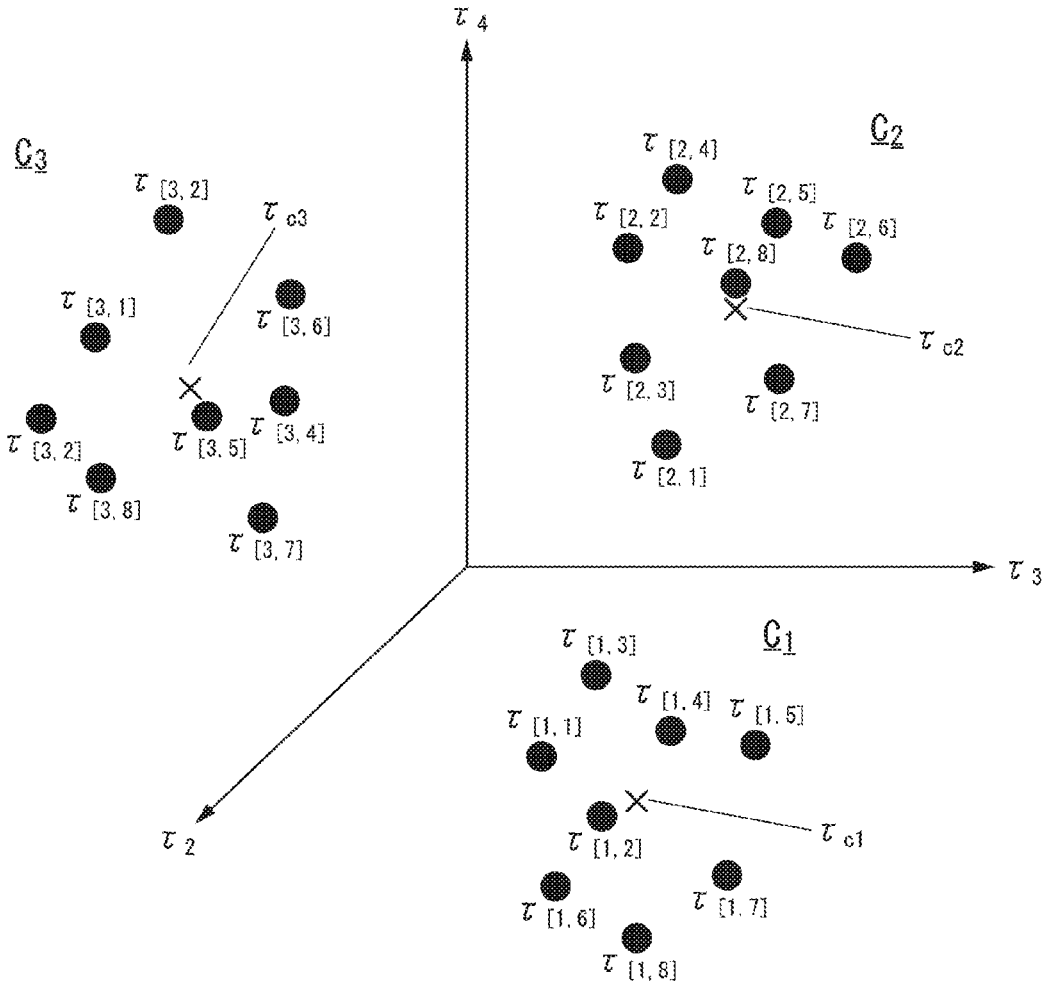
FIG. 2 is a conceptual diagram illustrating a distribution example of inter-channel time difference vectors.

FIG. 2 illustrates an example of the distribution of the inter-channel time difference vectors $\tau_{[n]}(\theta)$.

τ2, τ3, and τ4 indicate inter-channel time differences of channels 2, 3, and 4 which are respective elements of the inter-channel time difference vector $\tau_{[n]}(\theta)$. Black circles indicate individual channel time difference vectors $\tau_{[n]}(\theta)$. $C_1$, $C_2$, and $C_3$ indicate clusters consisting of a plurality of inter-channel time difference vectors $\tau_{[1,1]}$ to $\tau_{[1,8]}$, $\tau_{[2,1]}$ to $\tau_{[2,8]}$, and $\tau_{[3,1]}$ to $\tau_{[3,8]}$. $\tau_{c1}$, $\tau_{c2}$, and $\tau_{c3}$ indicate cluster centers of the clusters $C_1$, $C_2$, and $C_3$, respectively. In the example illustrated in FIG. 2, inter-channel time difference vectors $\tau_{[1,2]}$, $\tau_{[2,8]}$, and $\tau_{[3,5]}$ of which distances from the cluster centers $\tau_{c1}$, $\tau_{c2}$, and $\tau_{c3}$ are smallest are determined as the representative inter-channel time difference vectors of the clusters $C_1$, $C_2$, and $C_3$. The transfer functions $H_{[1,2]}(\theta, f)$, $H_{[2,8]}(\theta, f)$, and $H_{[3,5]}(\theta, f)$ of M channels that apply the inter-channel time difference vectors $\tau_{[1,2]}$, $\tau_{[2,8]}$, and $\tau_{[3,5]}$ are selected as the representative transfer functions related to the clusters $C_1$, $C_2$, and $C_3$, respectively.

The inter-channel time difference vector $\tau_{[n]}(\theta)$ is uniquely determined according to the target direction for the predetermined arrangement of the microphones 21-1 to 21-M. Therefore, even when a displacement (deviation) of the microphones 21-1 to 21-M or other errors are generated, the inter-channel time difference vector $\tau_{[n]}(\theta)$ is distributed within the cluster corresponding to a predetermined target position in the case of the normal microphone array 20. Further, in a case where an abnormality or noise in the microphone array 20 is generated, the inter-channel time difference vector $\tau_{[n]}(\theta)$ deviates from the cluster corresponding to the target position. Therefore, according to the representative transfer function determination unit 104, the representative transfer function for applying the inter-channel time difference vector of which a distance from a cluster center is within a predetermined distance range is selected as a transfer function with high reliability.

The representative transfer function determination unit 104 may exclude an inter-channel time difference vector of which a distance from a cluster center exceeds a predetermined distance (for example, twice a standard deviation) from a clustering target, perform clustering on remaining inter-channel time difference vectors again, and then, select a representative transfer function. In this case, since a transfer function with low reliability is excluded from the clustering target, a more appropriate representative transfer function is selected.

(Test Process)

Next, a test process according to the embodiment will be described.

Figure 3:
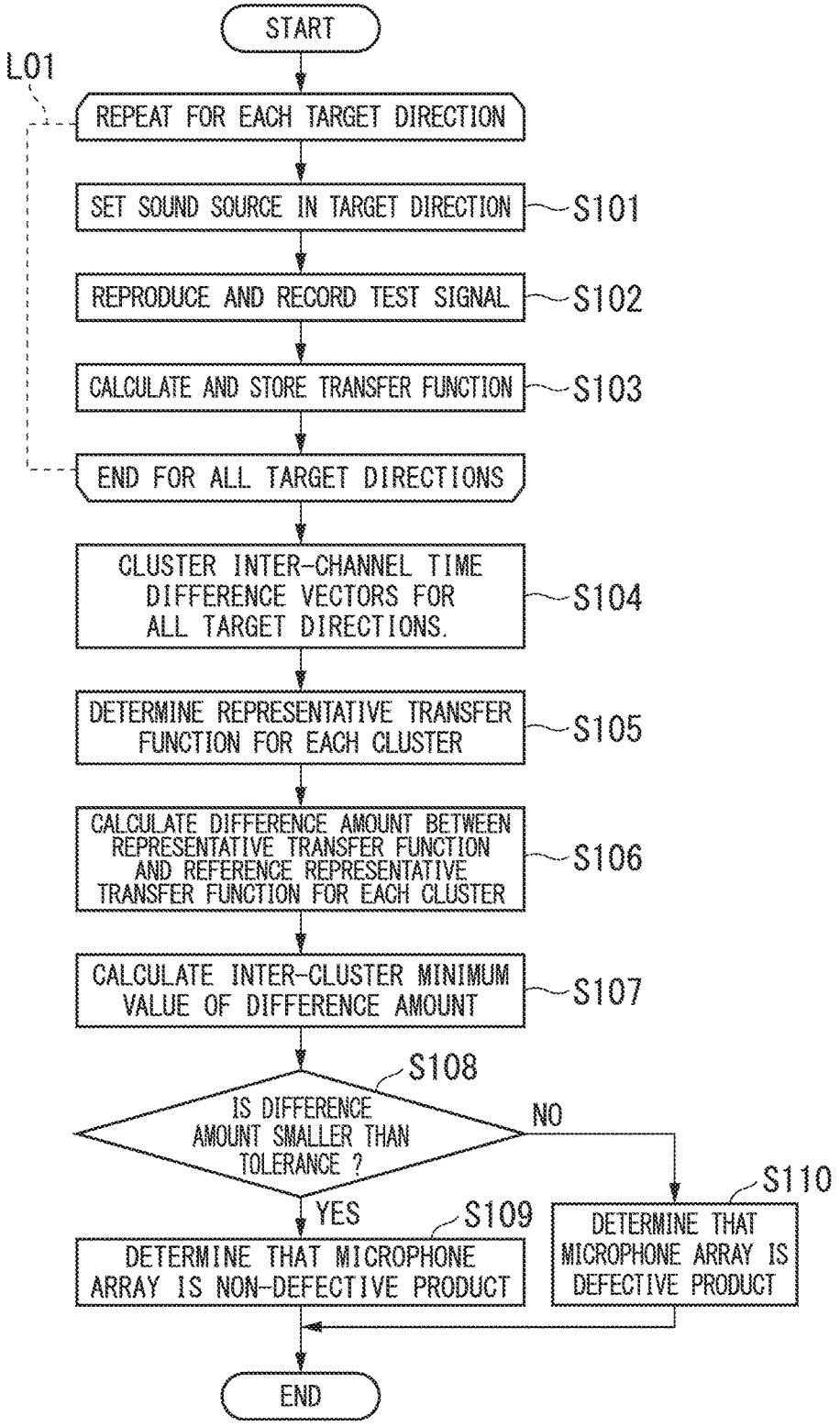
FIG. 3 is a flowchart illustrating a test process according to the embodiment.

FIG. 3 is a flowchart illustrating the test process according to the embodiment.

(Loop L01) Processes in steps S101 to S103 are repeated for each target direction. After the process is completed for all of target directions of a D direction, the process proceeds to a process in step S104. The processes of steps S102 and S103 may be repeated for one target direction a plurality of times.

(Step S101) The target direction setting unit 101 sets the target direction of the speaker 11. Thereafter, the process proceeds to step S102.

(Step S102) The test signal processing unit 102 generates a predetermined test signal and outputs the generated test signal to the speaker 11. From the speaker 11, sound based on the test signal is reproduced. The received sound signal generated by recording the sound from the speaker 11 is input from each of the microphones 21-1 to 21-M to the test signal processing unit 102. Thereafter, the process proceeds to step S103.

(Step S103) The transfer function calculation unit 103 calculates a transfer function on the basis of the test signal and the received sound signal of each channel for the set target direction. Thereafter, the process returns to step S101.

(Step S104) The representative transfer function determination unit 104 calculates the inter-channel time difference using the received sound signal used for calculation of the transfer function of M channels of each time in all target directions. The representative transfer function determination unit 104 clusters the inter-channel time difference vectors including the inter-channel time difference calculated each time as an element, in D clusters over all target directions. Thereafter, the process proceeds to step S105.

(Step S105) The representative transfer function determination unit 104 calculates an average value of the inter-channel time difference vector for each cluster as the cluster center. The representative transfer function determination unit 104 determines the transfer function of M channels that applies the inter-channel time difference vector of which a distance from the calculated cluster center is smallest as a representative transfer function. Thereafter, the process proceeds to step S106.

(Step S106) The determination unit 105 calculates the difference amount between the representative transfer function of M channels and a predetermined reference representative transfer function of M channels for each cluster. Thereafter, the process proceeds to step S107.

(Step S107) The determination unit 105 calculates the inter-cluster minimum value which is a difference amount that is smallest among the clusters among the calculated difference amounts. Thereafter, the process proceeds to step S108.

(Step S108) The determination unit 105 determines whether or not the inter-cluster minimum value of the difference amount is smaller than a predetermined tolerance. If it is determined that the inter-cluster minimum value of the difference amount is smaller than the predetermined tolerance (YES in step S108), the process proceeds to step S109. When it is determined that the inter-cluster minimum value of the difference amount is equal to or greater than the predetermined tolerance (NO in step S108), the process proceeds to step S110.

(Step S109) The determination unit 105 determines that the microphone array 20 is a non-defective product. Thereafter, the determination information indicating the determination result is output to the display unit 12, and the processing illustrated in FIG. 3 ends.

(Step S110) The determination unit 105 determines that the microphone array 20 is a defective product. Thereafter, determination information indicating the determination result is output to the display unit 12, and the process illustrated in FIG. 3 ends.

(Setting of Target Direction)

Next, an example of setting the target direction in the target direction setting unit 101 will be described.

FIGS. 4A to 4F are diagrams illustrating an example of setting the target direction.

Figure 4A:
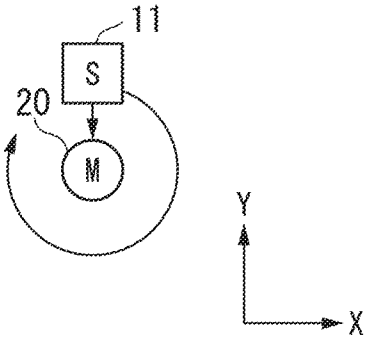
FIGS. 4A to 4F are conceptual diagrams illustrating an example of setting of a target direction.

FIG. 4A is a plan view illustrating an example of setting of a speaker movement type. In the example illustrated in FIG. 4A, an X direction and a Y direction which are orthogonal to each other within a horizontal plane are respectively shown to be directed to the right and the top in FIG. 4A. In the speaker movement type, one speaker 11 is moved on a circumference centered on a representative point on one microphone array 20 while the microphone array 20 stops at a predetermined position. The target direction setting unit 101 includes a driving unit for moving the position of the speaker 11 in each predetermined target direction on the circumference thereof. According to this configuration, it is easy to change the target direction according to each microphone array 20.

Figure 4B:
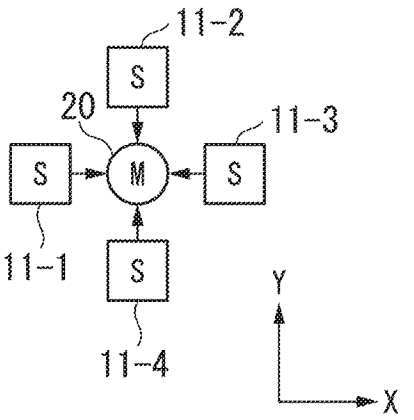

FIG. 4B is a plan view illustrating an example of setting of a multiple speaker stationary type. In the multiple speaker stationary type, a plurality (4 in this example) of speakers 11-1 to 11-4 are installed in respective target directions from a representative point on one microphone array 20. The target direction setting unit 101 sequentially determines the speaker installed in the set target direction among the speakers 11-1 to 11-4, as an output destination of a test signal. According to this configuration, it is not necessary for the target direction setting unit 101 to include a driving unit for moving the microphone array 20 or the speaker 11.

Figure 4C:
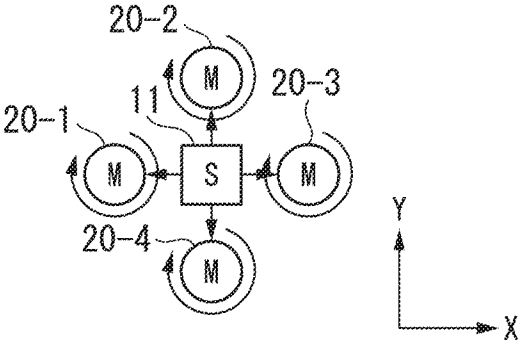

FIG. 4C is a plan view illustrating an example of setting of multiple microphone array turntable type. In the multiple microphone array turntable type, a plurality (four in this example) of microphone arrays 20-1 to 20-4 are installed on individual turntables around one speaker 11. The target direction setting unit 101 includes the turntables as driving units and rotates directions of the turntables so that the directions of the respective turntables become respective target directions. The test signal processing unit 102 acquires reception signals from the respective microphone arrays 20-1 to 20-4. According to this configuration, it is possible to simultaneously perform testing on the plurality of microphone arrays 20-1 to 20-4.

Figure 4D:
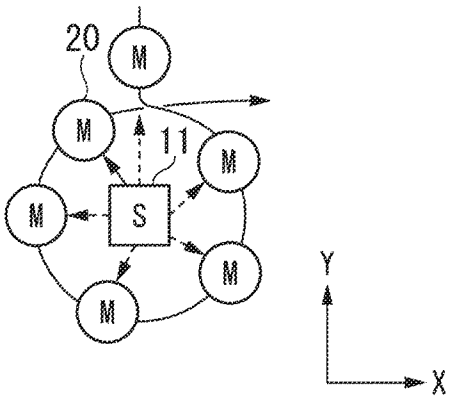

FIG. 4D is a plan view illustrating an example of setting of a multiple microphone array movement type. In the multiple microphone array movement type, a plurality of microphone arrays 20 are installed around one speaker 11 in a line mechanism that sequentially moves the plurality of microphone arrays 20 while maintaining directions thereof. The target direction setting unit 101 includes the line mechanism as a driving unit, and sequentially moves the line mechanism so that the direction of the speaker 11 from the respective installed microphone arrays 20 is any one of target directions. The test signal processing unit 102 acquires a reception signal from each microphone array 20. According to this configuration, it is possible to simultaneously perform testing on the plurality of microphone arrays 20.

Figure 4E:
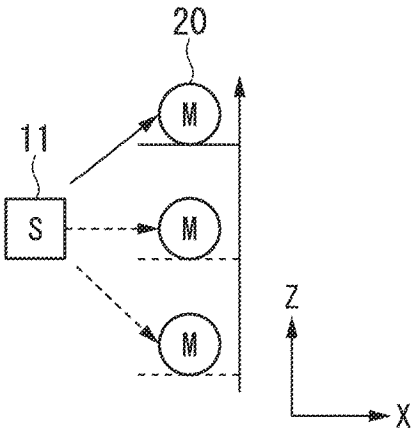

FIG. 4E is a side view illustrating an example of setting of a microphone array vertical movement type. In the example illustrated in FIG. 4E, an X direction which is one direction within a horizontal plane and a Z direction which is a vertical direction orthogonal to the horizontal plane are respectively shown as a right direction and an up direction in FIG. 4E. In the microphone array vertical movement type, the microphone array 20 is installed on a support base of a belt conveyor, and the support base is moved in a vertical direction to change an elevation angle as a target direction from the microphone array 20 to the speaker 11. The target direction setting unit 101 includes the belt conveyor as a driving unit for changing the elevation angle of the speaker 11 as a predetermined target direction. According to this configuration, it is possible to test the transfer function from the elevation angle direction as the target direction. Further, the belt conveyor includes a plurality of support bases and the microphone arrays 20 are installed in each support base, making it possible to simultaneously test the plurality of microphone arrays 20 on the basis of respective received signals.

Figure 4F:
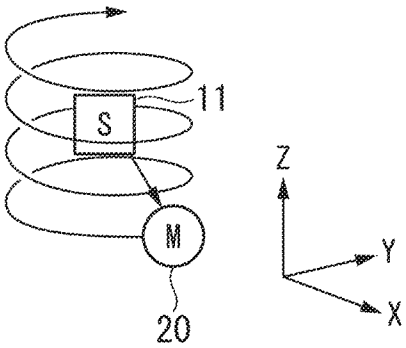

FIG. 4F is a side view illustrating an example of setting of a microphone array spiral movement type. In the example illustrated in FIG. 4F, an X direction which is one direction within a horizontal plane and a Y direction orthogonal to the X direction within the horizontal plane are respectively shown on a right oblique lower side and a right oblique upper side. In the microphone array spiral movement type, the microphone array 20 is installed around a speaker 11 and installed in a line mechanism that moves the microphone array 20 on a spiral trajectory in which a direction of a rotation axis is a vertical direction (Z direction). The target direction setting unit 101 includes the line mechanism as a driving unit and sequentially moves the line mechanism so that a direction of the speaker 11 from the installed microphone array 20 is any one of target directions. The test signal processing unit 102 acquires a received signal from each microphone array 20. According to this configuration, the test can be performed on the basis of the transfer function of an elevation angle direction as the target direction and an azimuth angle direction within the horizontal plane. Further, a plurality of microphone arrays 20 are installed on a track, making it possible to simultaneously test the plurality of microphone arrays 20 on the basis of respective received signals.

In the examples illustrated in FIGS. 4A and 4C to 4F, the driving unit generates noise as the speaker 11 or the microphone array 20 moves. In order to prevent mixing of noise, the test signal processing unit 102 outputs a test signal to the speaker 11 when the microphone array 20 is stationary, and acquires a received sound signal from the microphone array 20.

Further, in the examples illustrated in FIGS. 4C to 4F, it is preferable for the speaker 11 to be an omnidirectional speaker. An omnidirectional speaker is a speaker which has no significant difference according to a radiation direction of a radiation intensity of sound. Therefore, it is possible to reduce an influence of directivity of the radiation intensity as an error factor by using an omnidirectional speaker as the speaker 11.

(Modification Example)

Next, a modification example according to the embodiment will be described.

Figure 5:
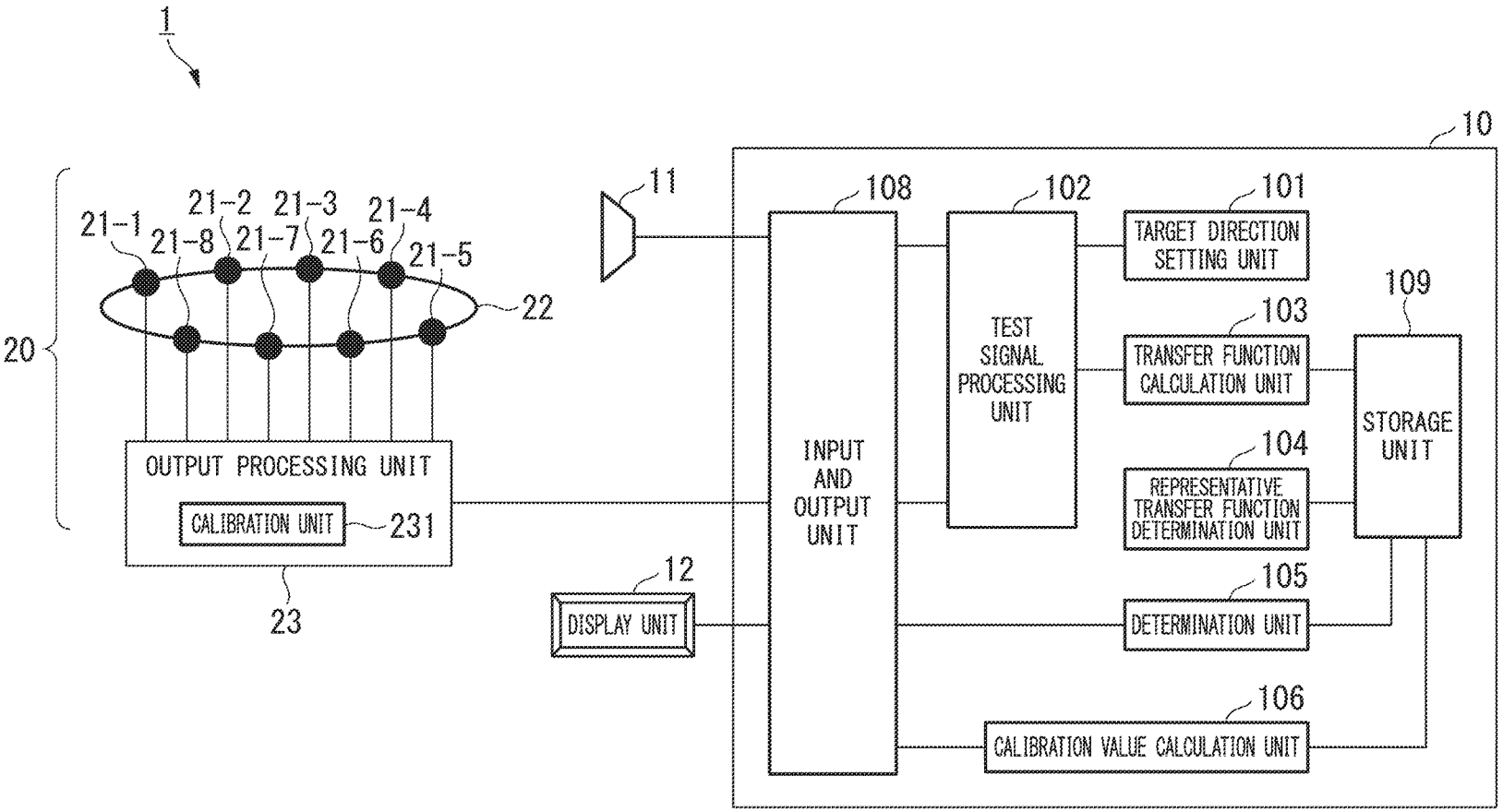
FIG. 5 is a block diagram illustrating a configuration of a test system according to a modification example of the embodiment.

FIG. 5 is a block diagram illustrating a configuration of a test system 1 according to this modification example.

In the test system 1 according to this modification example, a test device 10 further includes a calibration value calculation unit 106.

The calibration value calculation unit 106 calculates a calibration value for reducing the difference amount C with the reference representative transfer function $H_m'(d, f)$ of the cluster d corresponding to the target direction θ when the transfer function $H_{[n]m}(\theta, f)$ obtained from the reception signal of each channel m is multiplied by the calibration value. For example, the calibration value calculation unit 106 calculates an inter-cluster average of a ratio of the reference representative transfer function $H_m'(d, f)$ to the representative transfer function $H_m(d, f)$ as the calibration value $F_m(f)$, as shown in Equation (10). In Equation (10), < . . . > indicates an inter-cluster average of . . .

[Equation 10]

$$F_m(f) = \left\langle \frac{H_m'(d, f)}{H_m(d, f)} \right\rangle \tag{10}$$

The calibration value calculation unit 106 outputs calibration value information indicating the calculated calibration value $F_m(f)$ to the microphone array 20 via the input and output unit 108.

In this modification example, the microphone array 20 includes a calibration unit 231. The calibration unit 231 sets the calibration value $F_m(f)$ indicated by configuration value information input from the test device 10. The calibration unit 231 calibrates the received sound signal so that the received sound signal has a frequency characteristic obtained by multiplying a frequency domain coefficient of the received sound signal of each channel m by the calibration value $F_m(f)$ of the channel m. Accordingly, the transfer function $H_{[n]m}(\theta, f)$ obtained from the calibrated received signal and the reference representative transfer function $H_m'(d, f)$ of the cluster d corresponding to the target direction θ are used for approximation.

The calibration value calculation unit 106 may calculate the calibration value $F_m(f)$ so as to decrease the difference amount C as an index of a magnitude of a difference between a control variable and a target variable. In this case, the calibration value calculation unit 106 calculates a product of the transfer function $H_{[n]m}(\theta, f)$ and the calibration value $F_m(f)$ as an observation variable and calculates a reference representative transfer function $H_m'(d, f)$ of the cluster d corresponding to the target direction θ as the target variable. In order to calculate this calibration value $F_m(f)$, the calibration value calculation unit 106 can use a known optimization scheme such as a least squares method.

Although a case where the calibration value $F_m(f)$ of each channel m is represented by a frequency domain coefficient has been illustrated in the above-described example, the calibration value calculation unit 106 may calculate the calibration value represented as a time domain filter coefficient having equivalent frequency characteristics. In this case, when the calibration unit 231 calibrates the received sound signal represented in a time domain of each channel m, the calibration unit 231 may perform a convolution operation on the received sound signal using the calculated filter coefficient in the time domain.

As described above, the test device 10 according to the embodiment includes the transfer function calculation unit 103 that calculates the transfer function from the speaker 11 installed in the predetermined target direction to each of the microphones 21-1 to 21-M of the microphone array 20. Further, the test device 10 includes the determination unit 105 that determines whether or not the microphone array 20 is normal on the basis of the difference amount between the transfer functions to each of the microphones 21-1 to 21-M and the predetermined ideal transfer function to each of the microphones 21-1 to 21-M.

With this configuration, it is determined whether or not the microphone array 20 is normal on the basis of the difference amount between the transfer function from the speaker 11 installed in the target direction to each of the microphones 21-1 to 21-M and the ideal transfer function to each of the microphones 21-1 to 21-M. Therefore, it is possible to quantitatively determine whether the relative positional relationship between the microphones 21-1 to 21-M constituting the microphone array 20 is good or poor.

Further, the test device 10 includes a representative transfer function determination unit 104 that clusters a time difference between the microphones 21-1 to 21-M of the sound from the speaker 11 between the target directions and determines a transfer function corresponding to a representative value of the time difference for each cluster obtained by the clustering, as a representative transfer function. Further, the determination unit 105 determines whether the microphone array 20 is normal on the basis of an inter-cluster representative value of a difference amount between the representative transfer function and an ideal transfer function for each cluster.

With this configuration, a cluster consisting of the time difference between the microphones 21-1 to 21-M for each target direction is formed, and the representative value of the time difference for each formed cluster is determined as the representative transfer function. Since the transfer function corresponding to the target direction is determined as the representative transfer function, it is possible to avoid the influence of noise or other sound sources or the influence of a setting error for the target direction in the selection of the representative transfer function. Further, the inter-cluster representative value of the difference amount between the representative transfer function and the ideal transfer function for each cluster is a value representative of a degree of influence of noise or other sound sources that may vary between target directions or the influence of the setting error for the target direction. On the basis of this value, it is quantitatively determined whether or not the microphone array 20 is normal.

Further, the determination unit 105 calculates a Euclidean distance between the representative transfer function and the ideal transfer function as the difference amount.

With this configuration, contributions of the difference between the representative transfer function and the ideal transfer function are accumulated between the frequencies and the microphones 21-1 to 21-M, and thus the difference amount is calculated. Therefore, it is quantitatively determined whether or not the microphone array 20 is normal on the basis of physical characteristics of the transfer function according to the arrangement of the microphones 21-1 to 21-M.

Further, the determination unit 105 calculates the weighted Euclidean distance by multiplying the difference between the representative transfer function and the ideal transfer function by a predetermined auditory weighting characteristic, as the difference amount.

With this configuration, contributions of the difference weighted with the auditory weighting characteristic indicating the auditory characteristics for human noise are accumulated between frequencies and thus the difference amount is calculated. Therefore, it is quantitatively determined whether or not the microphone array 20 is normal on the basis of the auditory characteristic of the difference between the received sound signals generated according to the arrangement of the microphones 21-1 to 21-M.

Further, the determination unit 105 calculates an inter-frequency integral value of a weighted sum obtained by weighting each of the phase difference and the intensity difference between the representative transfer function and the ideal transfer function with predetermined weighting characteristics, as the difference amount.

With this configuration, as a difference in physical characteristics between the representative transfer function and the ideal transfer function, contributions of the weighted sum obtained by weighting the phase difference and the intensity difference with each of predetermined weight characteristics are accumulated between frequencies to calculate the difference amount. Therefore, it is quantitatively determined whether or not the microphone array 20 is normal on the basis of predetermined weight characteristics that are set for each of the phase difference and the intensity difference generated according to the arrangement of the microphones 21-1 to 21-M.

Further, the test device 10 includes the calibration value calculation unit 106 that calculates a calibration value for reducing the difference amount between the transfer function from the speaker 11 and the ideal transfer function.

With this configuration, a received sound signal approximate to the received sound signal from the microphone array giving the ideal transfer function can be acquired by calibrating the received sound signal from the microphones 21-1 to 21-M using the calculated calibration value. Further, troublesome work related to adjustment of various parameters such as an amplification factor and a phase of the received signal between the M channels, which is performed by the user, is reduced.

Although the embodiments of the present invention have been described above with reference to the drawings, specific configurations are not limited to those described above, and various design changes or the like can be made without departing from the gist of the present invention.

For example, if one or both of the speaker 11 and the display unit 12 can receive and output various signals from and to the input and output unit 108, it is not necessary for the speaker 11 and the display unit 12 to be integrated with the other components of the test device 10.

Some of the above-described test device 10, such as the target direction setting unit 101, the test signal processing unit 102, the transfer function calculation unit 103, the representative transfer function determination unit 104, the determination unit 105, and the calibration value calculation unit 106 may be realized by a computer. In this case, the units may be realized by recording a program for realizing a control function thereof on a computer-readable recording medium, loading the program recorded on the recording medium into a computer system, and executing the program. Here, the "computer system" may be a computer system embedded in the test device 10, which includes an OS or hardware such as a peripheral device, in addition to a control device such as a central processing unit (CPU). Further, the "computer-readable recording medium" refers to a portable medium such as a flexible disk, a magneto-optical disc, a ROM, or a CD-ROM, or a storage apparatus such as a hard disk embedded in the computer system. Further, the "computer-readable recording medium" may also include a recording medium that dynamically holds a program for a short period of time, such as a communication line when the program is transmitted over a network such as the Internet or a communication line such as a telephone line or a recording medium that holds a program for a certain period of time, such as a volatile memory inside a computer system including a server and a client in such a case. Further, the program may be a program for realizing some of the above-described functions or may be a program capable of realizing the above-described functions in combination with a program previously stored in the computer system.

Further, some or all of the target direction setting unit 101, the test signal processing unit 102, the transfer function calculation unit 103, the representative transfer function determination unit 104, the determination unit 105, and the calibration value calculation unit 106 in the above-described embodiment may be realized as an integrated circuit such as a large scale integration (LSI). The functional blocks of the target direction setting unit 101, the test signal processing unit 102, the transfer function calculation unit 103, the representative transfer function determination unit 104, the determination unit 105, and the calibration value calculation unit 106 may be individually implemented as processors or some or all of them may be integrated and implemented as a processor. Further, a scheme of implementation as an integrated circuit is not limited to an LSI, and the functional block may be realized as a dedicated circuit or a general-purpose processor. Further, when a technology for implementation as an integrated circuit to replace an LSI emerges with the advance of semiconductor technology, an integrated circuit based on the technology may be used.

What is claimed is:

1. A test device for a microphone array including microphones, comprising:

a sound source configured to be disposed in at least two predetermined target directions with respect to the microphone array;

a transfer function calculation unit configured to calculate a transfer function from the sound source to each of the microphones of the microphone array;

a determination unit configured to determine whether or not the microphone array is normal on the basis of a difference amount between the transfer function to each of the microphones and a predetermined ideal transfer function to each of the microphones; and a representative transfer function determination unit configured to form clusters for the predetermined target directions, each of the clusters having time differences between the microphones of sound from the sound source, obtain a representative value of the time differences for each of the clusters, and determine the transfer function corresponding to the representative value as a representative transfer function, wherein the determination unit is configured to determine whether the microphone array is normal on the basis of an inter-cluster representative value of differences between the representative transfer function and the ideal transfer function, for each of the clusters, as the difference amount.

2. The test device according to claim 1, wherein the determination unit is configured to calculate a Euclidean distance between the representative transfer function and the ideal transfer function, for each of the clusters, as the difference therebetween.

3. The test device according to claim 1, wherein the determination unit is configured to calculate a weighted Euclidean distance by multiplying a difference between the representative transfer function and the ideal transfer function, for each of the clusters, by a predetermined auditory weighting characteristic, as the difference therebetween.

4. The test device according to claim 1, wherein the determination unit is configured to calculate an inter-frequency integral value of a weighted sum obtained by weighting each of a phase difference and an intensity difference between the representative transfer function and the ideal transfer function, for each of the clusters, with a predetermined weighting characteristic, as the difference therebetween.

5. The test device according to claim 1, further comprising:

a calibration value calculation unit configured to calculate a calibration value for reducing the difference amount between the transfer function from the sound source and the ideal transfer function.

6. A test method of a microphone array including microphones, in a test device, comprising:

disposing at least one sound source and the microphones of the microphone array in at least two predetermined target directions with respect to each other;

a transfer function calculation step of calculating a transfer function from the sound source to each of the microphones of the microphone array;

a determination step of determining whether or not the microphone array is normal on the basis of a difference amount between the transfer function to each of the microphones and a predetermined ideal transfer function to each of the microphones; and a representative transfer function determination step of forming clusters for the predetermined target directions, each of the clusters having time differences between the microphones of sound from the sound source, obtaining a representative value of the time differences for each of the clusters, and determining the transfer function corresponding to the representative value as a representative transfer function, wherein the determination step determines whether the microphone array is normal on the basis of an inter-cluster representative value of differences between the representative transfer function and the ideal transfer function, for each of the clusters, as the difference amount.

* * * * *